US009487943B2

(12) United States Patent
Bui

(10) Patent No.: US 9,487,943 B2
(45) Date of Patent: Nov. 8, 2016

(54) COMPONENT BUILDING SYSTEM

(71) Applicant: Thuan Bui, Philadelphia, PA (US)

(72) Inventor: Thuan Bui, Philadelphia, PA (US)

( * ) Notice: Subject to any disclaimer, the term of this patent is extended or adjusted under 35 U.S.C. 154(b) by 0 days.

(21) Appl. No.: 14/210,306

(22) Filed: Mar. 13, 2014

(65) Prior Publication Data

US 2014/0259979 A1 Sep. 18, 2014

Related U.S. Application Data

(60) Provisional application No. 61/852,398, filed on Mar. 16, 2013.

(51) Int. Cl.

| | |
|---|---|
| ***E04B 1/21*** | (2006.01) |
| ***E04B 1/16*** | (2006.01) |
| ***E04B 5/04*** | (2006.01) |
| ***E04C 2/288*** | (2006.01) |

(52) U.S. Cl.

CPC ..... *E04B 1/21* (2013.01); *E04B 1/165* (2013.01); *E04B 5/04* (2013.01); *E04C 2/288* (2013.01); *E04B 1/164* (2013.01)

(58) Field of Classification Search

CPC ..... E04B 1/21; E04B 1/161; E04B 1/162; E04B 1/163; E04B 1/165; E04B 2/64; E04B 2/68; E04B 2/721; E04B 2/84; E04B 2/88; E04B 2/90; E04B 2/2885; E04B 5/04; E04C 3/34

USPC ..... 52/79.11, 235, 250–252, 259, 270, 271, 52/432, 436, 439, 309.12, 581

See application file for complete search history.

(56) References Cited

U.S. PATENT DOCUMENTS

| | | | | |
|---|---|---|---|---|
| 1,549,951 | A * | 8/1925 | Aiken | 52/250 |
| 1,711,241 | A * | 4/1929 | Miller | 52/432 |
| 2,940,294 | A * | 6/1960 | Carlson | 52/274 |
| 3,300,943 | A * | 1/1967 | Owens | 52/745.11 |
| 4,147,009 | A * | 4/1979 | Watry | 52/742.15 |
| 4,338,759 | A * | 7/1982 | Swerdlow et al. | 52/742.14 |
| 4,398,378 | A * | 8/1983 | Heitzman | 52/251 |
| 4,454,702 | A * | 6/1984 | Bonilla-Lugo et al. | 52/745.13 |
| 4,573,303 | A * | 3/1986 | Figari | 52/742.14 |
| 4,731,971 | A * | 3/1988 | Terkl | 52/742.14 |
| 5,335,472 | A * | 8/1994 | Phillips | 52/742.14 |
| 5,697,189 | A * | 12/1997 | Miller et al. | 52/79.9 |
| 5,887,404 | A * | 3/1999 | Kreizinger | 52/592.1 |
| 6,223,480 | B1 * | 5/2001 | Khoo | 52/79.9 |
| 6,244,008 | B1 * | 6/2001 | Miller | 52/602 |
| 2011/0047928 | A1 * | 3/2011 | Aburto | 52/745.05 |
| 2011/0282633 | A1 * | 11/2011 | Bui | 703/1 |
| 2012/0047816 | A1 * | 3/2012 | Zhong | 52/11 |
| 2012/0167501 | A1 * | 7/2012 | Tikhovskiy | 52/251 |
| 2012/0167502 | A1 * | 7/2012 | Tikhovskiy | 52/251 |

FOREIGN PATENT DOCUMENTS

WO 2013/032349 * 3/2013

* cited by examiner

*Primary Examiner* — Robert Canfield

(74) *Attorney, Agent, or Firm* — Bui Garcia-Zamor; Jessica H. Bui, Esq.

(57) ABSTRACT

A component building system combines both precast elements and cast-in-place elements that is cost effective, more cultural acceptance, and adaptable for constructing single story to high-rise building structures. The component building system comprises mostly open rib or closed sandwich wall panel components that are limited or non-load bearing panel connecting between main columns in the concrete frame superstructure.

16 Claims, 9 Drawing Sheets

COMPONENT BUILDING SYSTEM

CROSS-REFERENCE TO RELATED APPLICATIONS

This application is a non-provisional application of an earlier U.S. provisional patent application Ser. No. 61/852,398, filed on Mar. 16, 2013.

FIELD OF INVENTION

The invention relates to a precast building system and, more specifically, relates to the latest and best aspects of precast technology and incorporate the same in the traditional cast-in-place concrete frame system to produce a reliable, trusted and economical building solution for high speed and high volume production.

BACKGROUND OF THE INVENTION

Building structures are often built on site in most parts of the world. The problems of site constructions are well documented in past journal articles. The major problems of many site building methods are their high amount of skilled labor requirements and complexity of the building structures. In cases where the building system is too foreign to the local market, system acceptance will be very low. There are certainly many different types of building systems available in the market that compete to reduce cost, provide speed construction, and provide a more energy-efficient envelope at the same time. However, no system can reduce cost sufficiently, increase construction speed, provide more energy-efficient envelope, and have more culturally acceptable features at the same time. The local market, particularly, in the developing countries is enormous because these developing countries are where the majority of the world population growth occurs in the last 35 years.

The precast building industry has been evolving slowly for the last few decades in developed countries including United States and Europe. The core concept of most precast systems is still based mainly on very heavy load-bearing wall components. Load-bearing wall panel is a panel designed to carry the load above the panel and does not rely on a column system to support the load. In contrast, the non-load bearing wall panel is designed to carry load above the panel. However, a typical load-bearing wall system inherently has limitations in application and practice in most developing markets. For example, a typical precast system requires a large amount of capital for heavy equipment to manufacture and handle its panel components, making it a very unattractive investment relative to traditional cast-in-place system which is more easily practiced and implemented without heavy machinery. As a result, traditional cast-in-place concrete system remains widely practiced everywhere, including both developed and developing countries for many generations.

An example of such a traditional cast-in-place concrete superstructure 10 is shown in FIG. 1A and FIG. 1B including widely practiced traditional concrete columns 11 and traditional concrete floor systems 12 for low rise and high rise structure. FIG. 1A shows a traditional cast-in-place concrete frame superstructure 10 including cast-in-place columns 11 and floor systems 12 for a single story or low rise structure. In contrast, FIG. 1B shows a traditional cast-in-place concrete frame superstructure 10 including cast-in-place columns 11 and floor systems 12 for multiple stories or high rise structure. In either embodiment, its cast-in-place concrete frame superstructure 10 is well understood and trusted for generations. The superstructure's columns 11 are designed to carry the structure's load. In designing and determining the load capacity of the structure, the traditional cast-in-place concrete frame superstructure 10 will be much easier to understand and be trusted by the local developing population than a load-bearing precast wall system.

Another major advantage of traditional cast-in-place concrete superstructure over traditional load-bearing precast wall systems without columns is its flexibility for future renovations. For example, partition walls can be easily knocked down or moved to accommodate new floor layout or usage of space as space usage changes in time. However, the traditional cast-in-place concrete system, as shown, for example, in FIGS. 1A-1B, also has its weaknesses. Its biggest weakness lies in the construction of walls and partitions between load-bearing columns 11. The traditional method uses hundreds or thousands of concrete blocks or clay bricks to build the walls. Inherent major problems include slow construction speed, inconsistent quality and lack of insulation. In most cases its energy and noise performance is far lower than precast insulated walls. In today's environment and in the future, where energy consumption continues to rise as living standards increase, walls with insulation in them will save energy. In normal construction steps, the cast-in-place superstructure 10 is constructed first and is then followed with the construction of envelope walls and all partition walls. In the last few decades, another type of non-precast system using a light gauge steel frame and a thin sheathing has become an attractive alternative; however, acceptance has been very slow as most people in the developing market still prefer traditional masonry walls and do not like the flimsiness of its covering and its durability when compared to the traditional masonry walls.

Given the fact that at least 80% of 7 billion world population is living in developing countries and living mostly in traditional concrete frame housing, any precast system that does not resemble what people have been used to for generations and can offer better performance over traditional system will have little chance of acceptance and adoption. In addition to being unfamiliar in the local engineering community and end users, the high level of initial capital investment required for precast systems will make them unviable as a solution. Other non-concrete or non-masonry solutions have the same problem in their adaption as well. When people buy something as significant as their home they will want to buy something they trust and that has better value. A new building solution is desperately needed that has to be cheaper, faster construction time, higher thermal efficient performance to save energy, and has more culturally acceptable features as well.

In any market and in any innovation, end users or consumers will always accept and buy a better mouse trap because of its greater perceived value. The old mouse trap in construction technology can be referred to as traditional reinforced concrete frame with cast-in-place columns, beams, and floor. Typical load-bearing precast system from developed countries will not be perceived by the mass population in developing countries as a better mouse trap because of its lack of resemblances. This explains why most evolved precast building systems of the developed countries have failed in developing markets. The mouse trap—a home—is the most significant purchase in a person's life. As a result, not too many people are willing to buy something that does not perceive as a better mouse trap than the one they grew up in.

In recognizing all factors stated above, there is a need for a better building solution, particularly, in developing countries where developers or general contractors often do not have the excess capital for heavy equipment for traditional load-bearing precast systems.

SUMMARY OF THE INVENTION

Accordingly, it is therefore an object of the present invention to provide a new building component system that is low cost and simple for single store to high-rise structure and that has faster construction time, higher thermal performance, and more culturally acceptable features, particularly for developing countries where developers or general contractors often do not have the excess capital for heavy equipment for traditional load-bearing precast systems.

It is also an object of the present invention to provide a lightweight precast component system designed to adopt the traditional cast-in-place concrete superstructure and to reduce construction time, cost of labor and materials, while achieving higher thermal efficiency and durability and familiarity.

It is also an object of the present invention to provide a hybrid building system that integrates both elements of precast and cast-in-place technologies made possible by its precast wall panel design and specifications.

It is further an object of the present invention to provide a precast wall panel component designed to span and connect between traditional concrete columns and beams in the traditional concrete superstructure and designed to be as light as possible (no more than 5 Ton) without concern to its load-bearing capacity.

In accordance with an aspect of the present invention, the hybrid building system combines both precast panel elements and cast-in-place concrete superstructure method. The required precast elements are non-load bearing precast wall panels of certain size, type, design, and weight and any precast floor panel. The cast-in-place elements are columns, beams, and floor system resembling the traditional concrete superstructure frame that everyone recognizes and trusts. Essentially, the hybrid building system according to the present invention is designed to speed up construction speed and provide better performing wall by replacing hundreds of concrete or brick blocks with one or two precast wall panels between columns as cladding walls and partition walls. The system columns and beams in this hybrid building system are of the same traditional construction. The system floor panel can be of any ordinary precast floor panel or cast-in-place slab floor system; however, the preferred floor system disclosed in this application is of an open rib panel design and/or of cast-in-place floor system. This pre-assembled floor panel is made of a light gauge steel frame with a top sheathing. The floor panel system can be either a removable formwork or stay-in-place formwork, which is a temporary or permanent mold in which concrete or similar materials are poured. The light gauge steel frame is made of four main U or C or of both U and C steel sections assembled into a frame with a top sheathing. When the floor panels are assembled over the precast wall panels, cavities for forming floor joists are created. When compared to traditional floor slab, the floor panel system according to the present invention will reduce both concrete and steel content.

In accordance with another aspect of the present invention, the hybrid building system concept is enabled only by non-load bearing precast wall panel design and its specification. As previously discussed, the non-load bearing precast wall panel is designed to carry load above the panel. The panel basic design can be of an open rib or closed sandwich wall panel. The typical wall panel has a maximum width of 8 meter and has a height that stretches between floor beams in the superstructure, so that no more than two panels are connected between concrete columns with a cross-section area more than 7100 square millimeter (11 square inch) and floor beams in the superstructure. The construction of columns and beams of this hybrid building system is the same as traditional cast-in-place frame system. The wall panel weighs no more than 5 tons—so that lighter and cheaper class of equipment can be used in manufacturing, transporting, and erecting it at building site. Both panel types in this system use minimal concrete for their integrity and with enough reinforcement to prevent shrinkage cracks and cracks during its handling. The wall panel has a minimum panel thickness of 90 mm or 3.5 inches. The concrete layer of the open rib and closed sandwich panel has a maximum panel thickness of 2 inch or 50 mm under reveals and is made of concrete that is structural or non-structural class and has a maximum panel weight of 35 lb/ft2 or 170 kg/m2. Most load-bearing wall panels in the industry are heavier than 35 lb/ft2 or 170 kg/m2. The left and right side of each wall panel has protruding edges to reduce water penetration to the inside and help to stabilize the panel position when wet concrete is in column cavity. In this system the main joint connection is made via embedded steel rod or bolt put in place prior to casting concrete columns and floor beams. For large wall panels its side is sprayed with a releasing agent in order to prevent cold bonding between column and panel. In such case, the panel connection relies solely on connection steel bolts or rods. Since concrete panels and columns shrink, expand, or move in micro millimeters under various conditions this design joint system will allow movements and prevent crack in panels. Provision such as covering the micro joint line with a fiberglass mesh and an elastic joint compound can hide the joints completely. Thus, it now can become a joint-less precast system. Cracks and water penetrations are the common problems associated with traditional precast systems. The protruding edge of one side of the wall panel can be longer than the other side of the wall panel in order to save the formwork and reduce labor cost associated with that side. In other case, the wall panel can only have one protruding edge on its left and right side. All wall panels may have another optional extended edge on the top side of the wall panel to save the exterior formwork when casting the concrete floor and the floor beam. This wall panel design with the combination of disclosed features represents a departure from traditional precast panel design in the industry.

In accordance with another aspect of the present invention, the construction process of this hybrid building system is different from traditional building system and is described as follow for constructing a single story to a high-rise building:

Step 1—The wall and floor panels are precast at site or at factory.

Step 2—The wall and floor panels are transported to site and are then erected.

Step 3—One or more rebars are placed in column cavities and then add additional formworks.

Step 4—Place floor panels on wall panels as an option.

Step 5—Concrete is poured for columns and is then set for 24 hrs.

Step 6—Floor panels are placed over the wall panels and steel reinforcements and formworks are put in place if step 4 is not used.

Step 7—Concrete is poured for beams, joists, and top floor slab and is then allowed to set for 24 hrs.

Step 8—Repeat step 2 to step 6 until all floor panels are constructed.

In some cases, the system columns can be cast before wall panel erecting. However, such method is not efficient and would incur higher cost but it is an option.

BRIEF DESCRIPTION OF THE DRAWINGS

A better understanding of the present invention will become apparent from the following detailed description of example embodiments and the claims when read in connection with the accompanying drawings, all forming a part of the disclosure of this invention. While the following written and illustrated disclosure focuses on disclosing example embodiments of the invention, it should be clearly understood that the same is by way of illustration and example only and that the invention is not limited thereto. The spirit and scope of the present invention are limited only by the terms of the appended claims. The following represents brief descriptions of the drawings, wherein:

DETAILED DESCRIPTION OF THE INVENTION

Figure 1A:
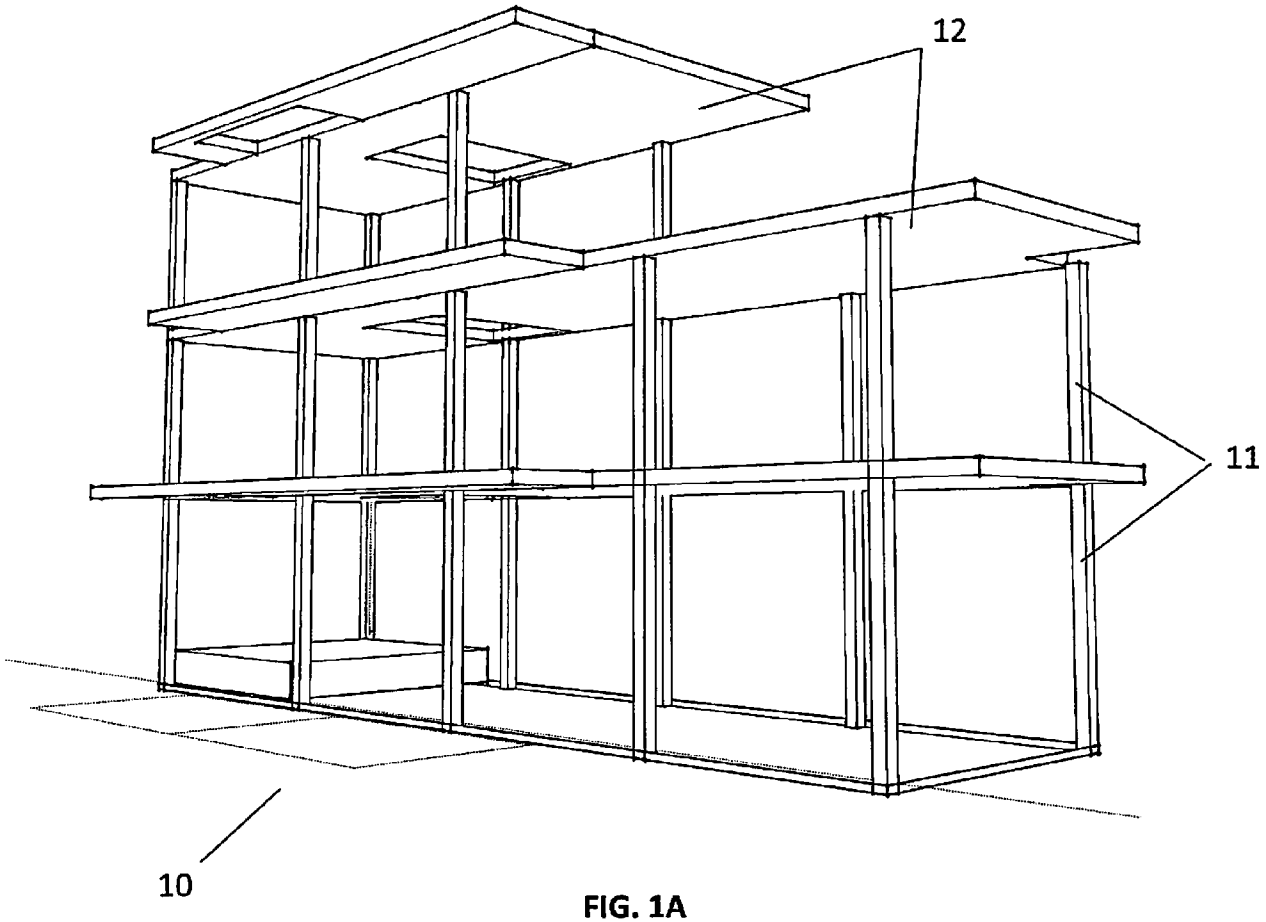
FIG. 1A CONVENTIONAL ART
FIGS. 1A-1B illustrate a traditional cast-in-place concrete superstructure frame 10 that is widely practiced with columns 11 designed to carry all vertical load and traditional floor systems 12 for low rise and high rise buildings.
Figure 1B:
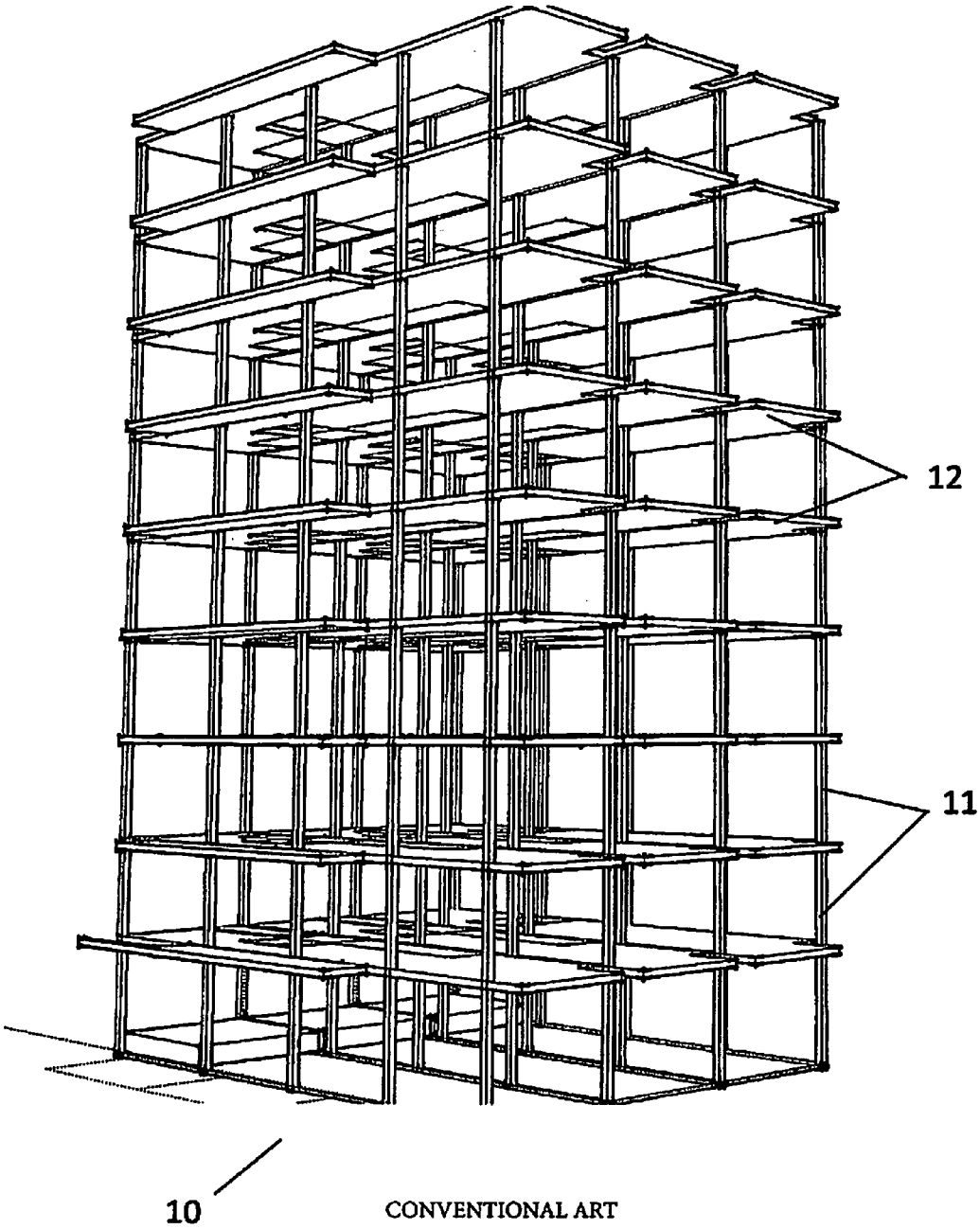
CONVENTIONAL ART FIG. 1B
Figure 2:
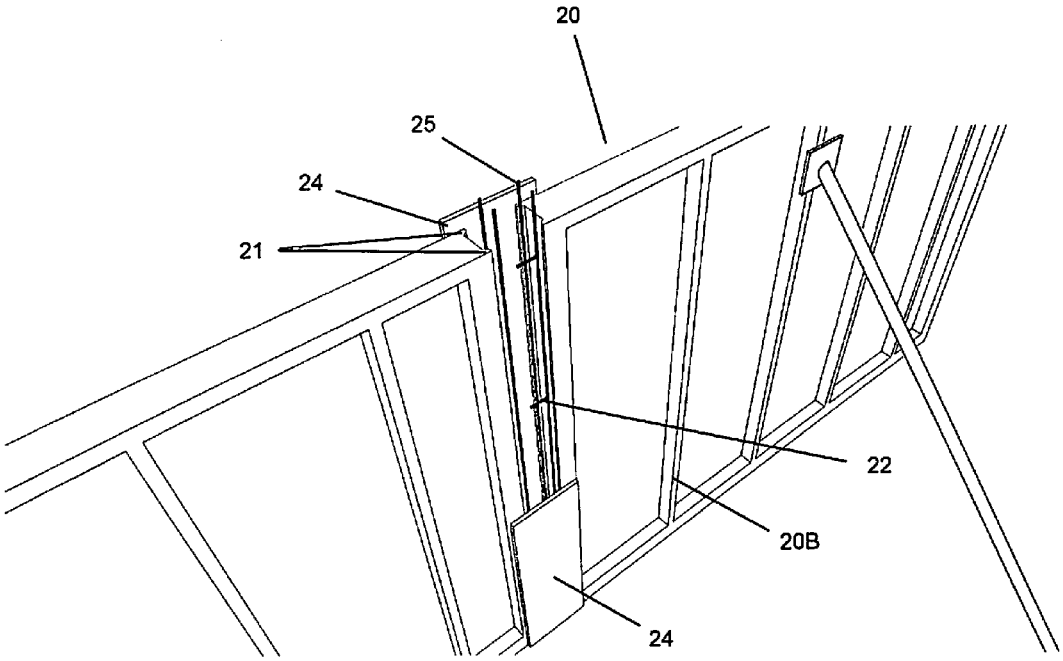
FIG. 2 illustrates an example assembly of two precast wall panels 20 as an open rib wall panel type with protruding edges 21 on its left and right sides with embedded connectors 22 erected, and with rebar 25 for column and with formwork 24 in place.

Referring now to FIG. 2 which illustrates a component precast system that is a hybrid building system designed to integrate both elements of precast and cast-in-place technologies and made possible by its precast wall panel design and specifications according to an embodiment of the present invention. As shown in FIG. 2, the component precast system comprises mainly lightweight precast wall panel components designed to span and connect between traditional concrete columns and beams in the traditional concrete superstructure 10 as shown in FIG. 1A and FIG. 1B. The wall panel component 20 is designed to be as light as possible (no more than 5 Ton) without concern to its load-bearing capacity. The concrete layer in panel can be of regular or lightweight concrete. Essentially, the precast wall panel 20 is designed as a cladding panel to replace the hundreds of concrete block or clay bricks between columns and provide higher performance walls.

Figure 4:
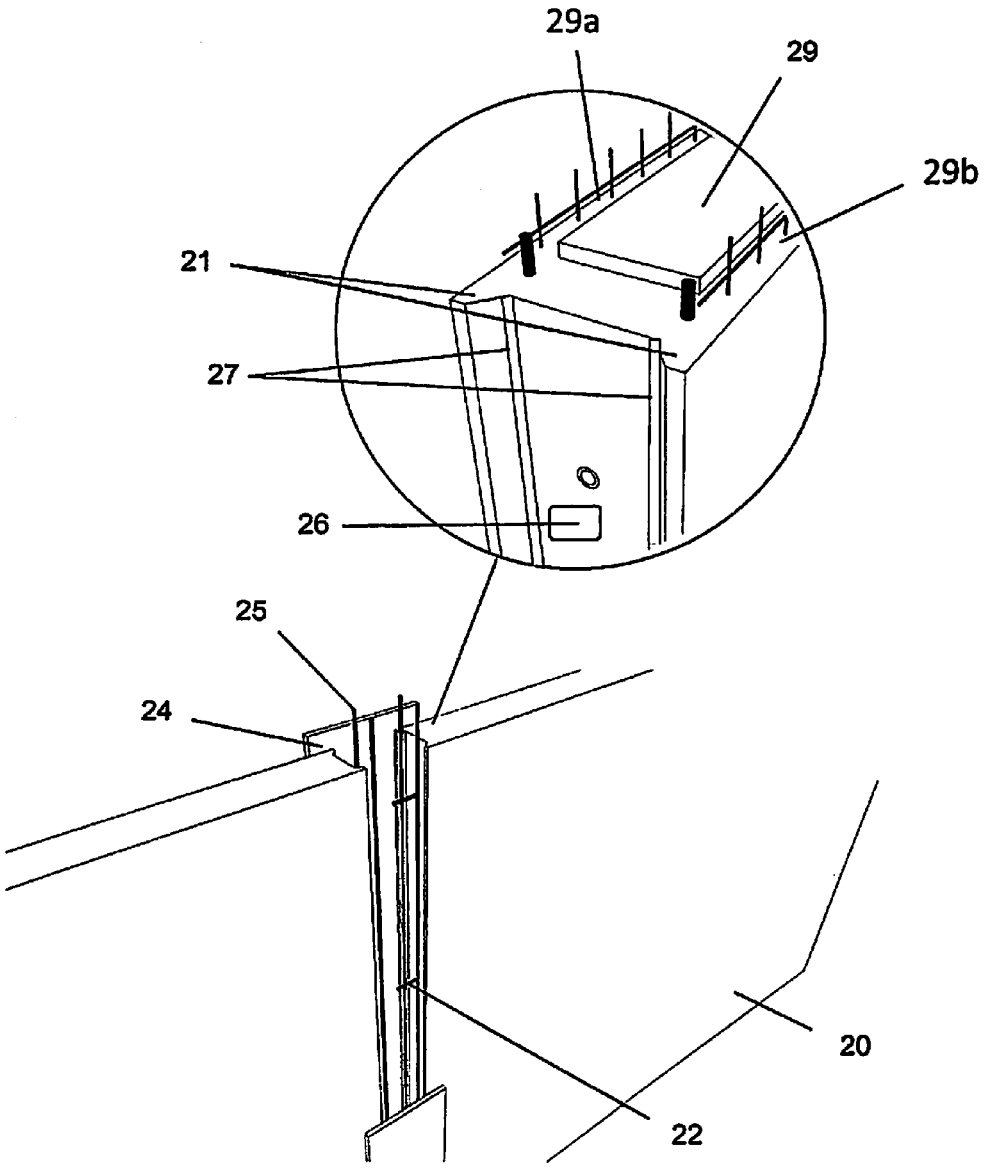
FIG. 4 illustrates an example assembly of two wall panels 20 as a closed sandwich wall panel type with protruding edges 21 on left and right sides of each wall panel 20, with optional beads of sealant 27 applied and with an optional thin coat of release agent 26 applied for large wall panels prior to casting concrete into column cavity. Examples of connecting devices include bolt like type, steel rod type, or other steel devices 22 embedded in the precast panels 20. Additional formworks 24 are attached to the wall panels 20 temporarily and to be removed after the concrete poured in column cavities is hardened.
Figure 7:
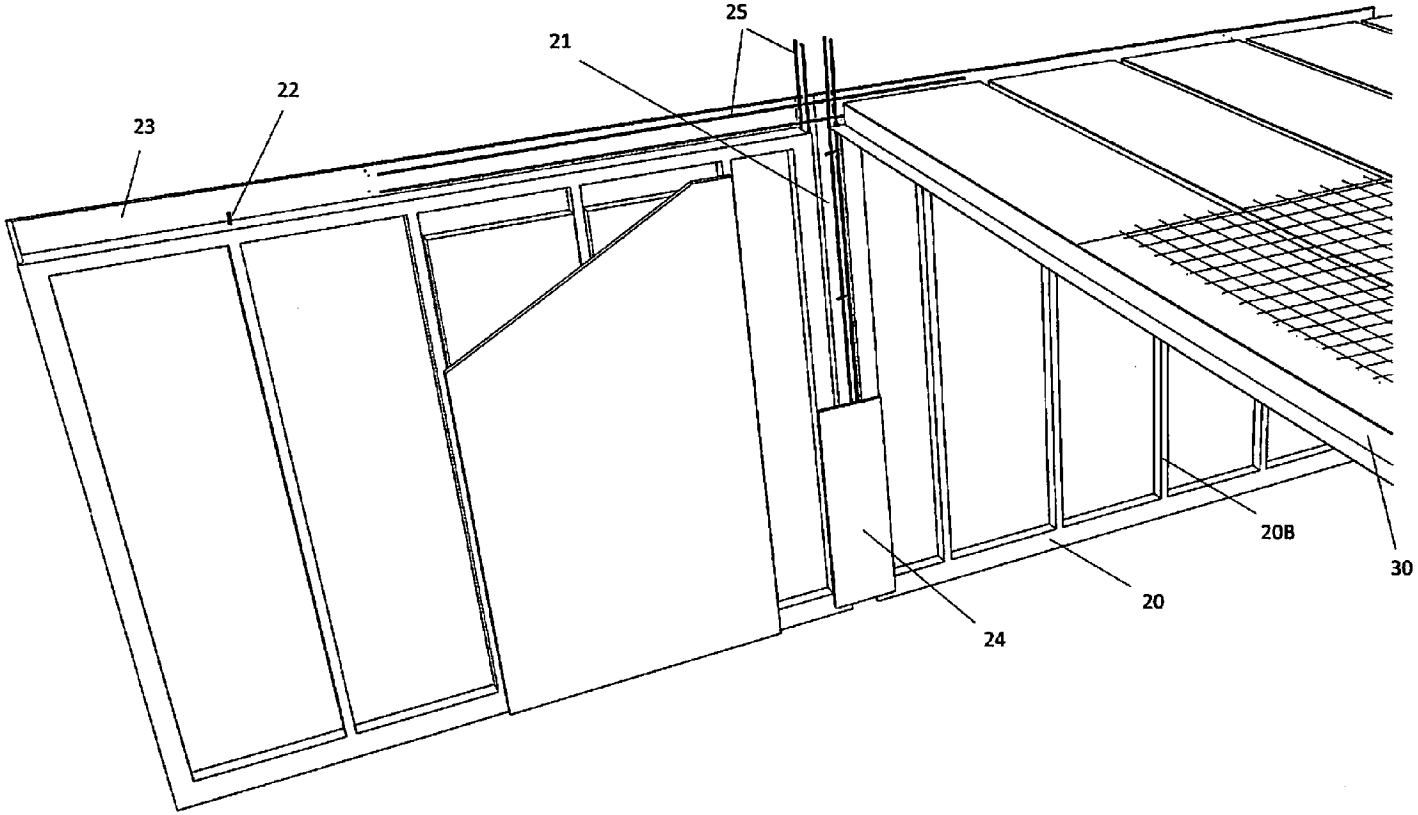
FIG. 7 illustrates an example assembly with both open frame wall panels 20 and floor panels 30 assembled before concrete pouring. The precast panel 20 has an extending edge 23 at a top side that serves to eliminate the need for additional formworks for cast-in-place beams in the floor system, and a protruding edge 21 on left and right sides of each wall panel 20.
Figure 8:
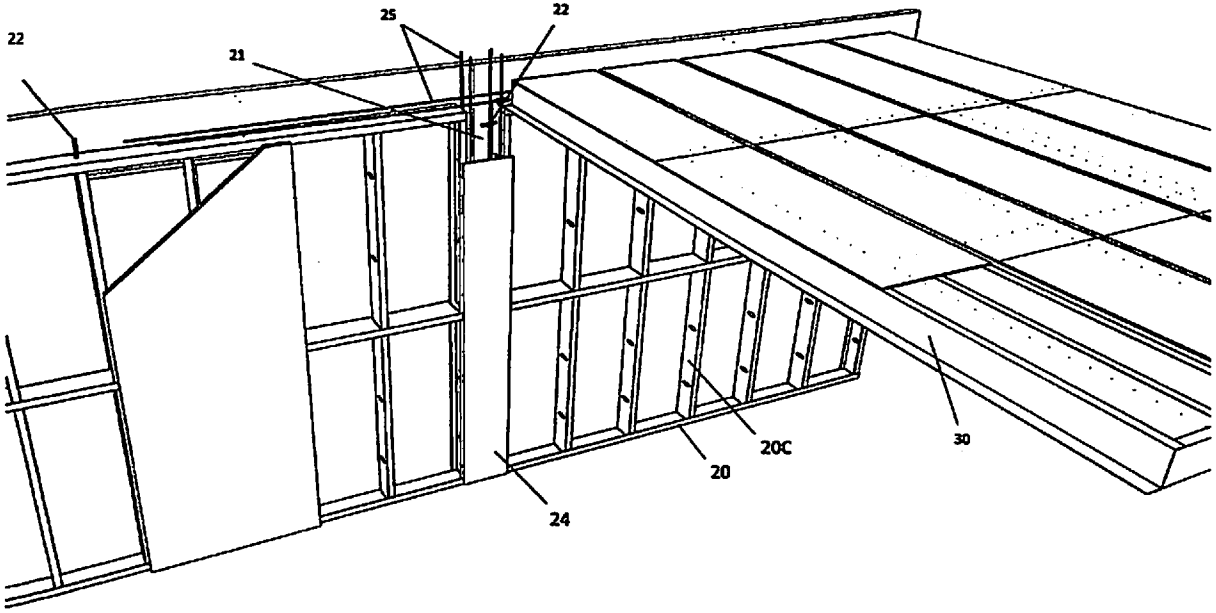
FIG. 8 illustrates an example assembly with both open frame wall panels 20 and floor panels 30 assembled before concrete pouring. The precast panel 20 is now a composite precast panel with a back support system made of steel frame 20C. The front concrete slab attached to frame system 20C is extended on top and left and right side of panel 20. The connecting devices are of bolt type or other steel devices 22.

As shown in FIG. 2 though FIG. 4, the typical precast wall panel 20 whether its design is an open rib/frame or a closed sandwich panel acts like a precast substitution for traditional masonry block or clay brick infill wall that spans between columns of the concrete superstructure 10 shown in FIGS. 1A-1B. A closed sandwich panel design is illustrated in FIG. 4. The precast wall panel 20 is made of a foam insulation core 29 covered by front 29*a* and back 29*b* concrete layers. An open rib or frame panel design type is best illustrated in FIG. 2, FIG. 7, and FIG. 8. For example, concrete ribs 20B of panel 20 can be made of re-enforced concrete as shown in FIG. 2 and FIG. 7. Alternatively, the concrete ribs 20B frame of panel 20 can be made of steel frame 20C as shown in FIG. 8. The open rib/frame panel 20 is designed to be closed with gypsum boards, cement board, or other sheathing boards after utilities lines or insulation is in placed.

Because manufacturing and handling equipment used for heavy precast panels costs a lot more than for panels less than 5.1 Ton, the precast wall panel 20 has a limit weight of 5 Ton. For most high-rise buildings with a large floor area, the panels 20 are limited to 1.5 Ton due to limitations of tower cranes. Each precast wall panel 20 has a thickness equal to or greater than 75 mm or 3 inches and is made of structural concrete or non-structural concrete. The precast wall panel 20 is designed to have a weight under 35 lb/ft2 or 170 kg/m2 and to serve as non-load bearing class wall.

Figure 3:
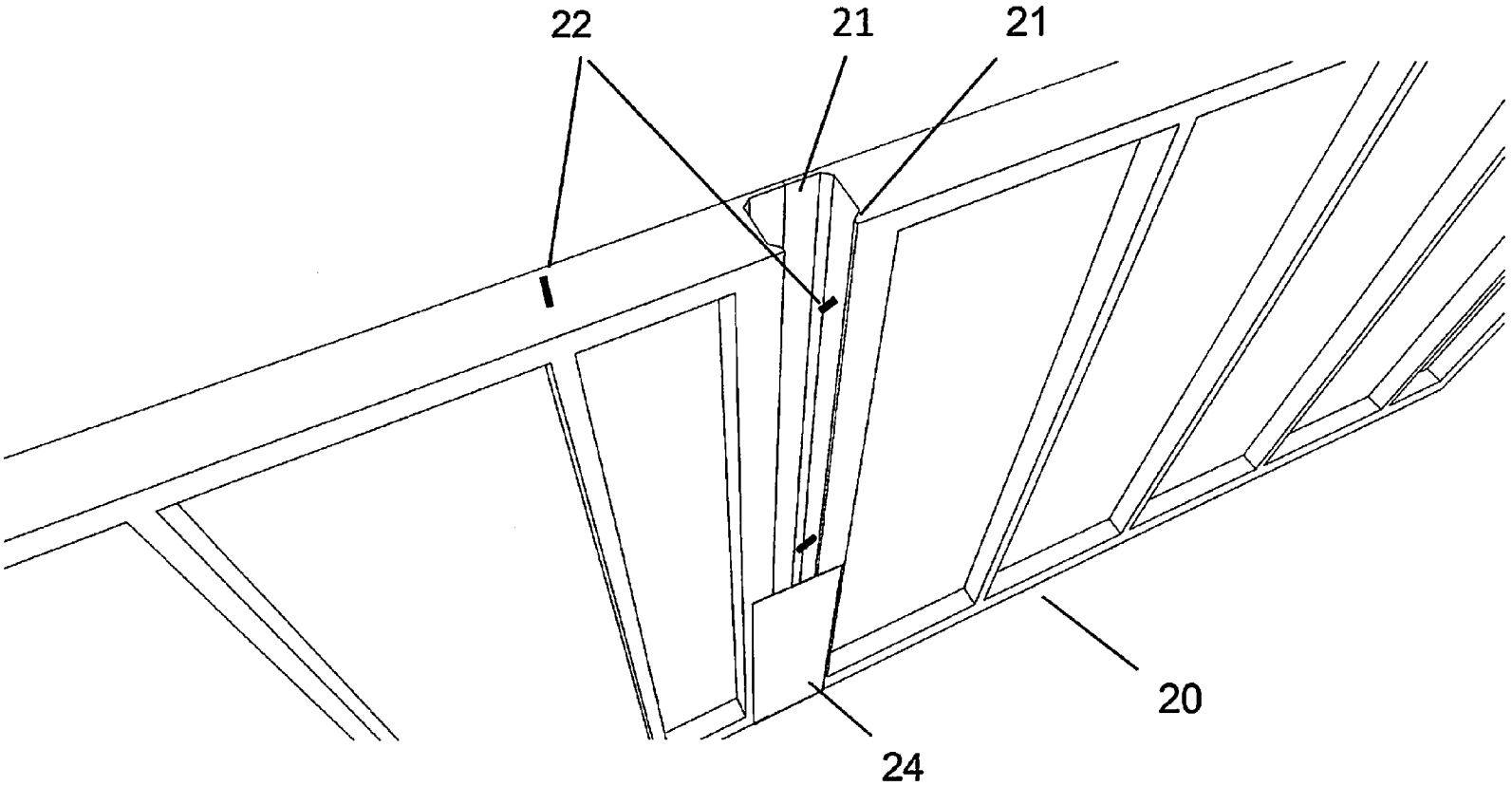
FIG. 3 illustrates an example assembly of two wall panels 20 as an open rib wall panel type with one edge 21 extended beyond the other edge 21 on its opposite side of each wall panel, and with embedded connecting devices 22.

As illustrated in FIG. 2 to FIG. 4, each precast wall panel 20 has two extended edges 21 on left and right sides of the wall panel 20. The protruding edges 21 are designed to help increase resistance in path of possible water penetration and, in many cases, serve to stabilize the panel position when the pressure of wet concrete applies to the edges in opposite directions and to reduce shearing force in the steel connecting devices when wind load is applied. As shown in FIG. 4, the wall panel 20 has embedded connection devices of steel rod or bolt or other steel connectors 22. Bolt type devices 22 are preferred because such devices can be adapted to allow slight movement. After the precast wall panels 20 are erected, rebar is placed in column cavities having a cross-section greater than 11 square inches (7100 square millimeter). Optionally, beads of sealant 27 are applied before a thin coat of release agent 26 is applied for a larger wall panel.

The release agent 26 is meant to prevent the concrete within the columns from bonding to the wall panel 20. Concrete in columns and panels shrinks slightly under various moisture conditions and the structure frame 10 can move back and forth slightly in high-wind and seismic conditions. The bolt connector devices 22 in the hairline joint gaps will allow slight movements in the assembly without putting too much stress on the precast wall panels 20.

FIG. 2 to FIG. 4 show how a column is to be cast right after wall panels 20 are erected, then the floor panels 30 are placed afterward on the wall panels 20. As shown in FIG. 2, FIG. 4, and FIG. 7, the rebars are constructed in the same traditional method. The protruding edge 21 of the side of wall panel 20 can extend far enough to eliminate the formwork on one side as shown in FIG. 3 and FIG. 7. The wall panels 20 can also have an additional protruding edge 23 on a top side extended far enough to eliminate the need of formworks for forming horizontal beams above the wall panels 20 as shown in FIG. 7. The non-load bearing precast wall 20 of an open frame design can be of steel frame system attached to a thin slab of concrete as shown in FIG. 8.

Figure 5:
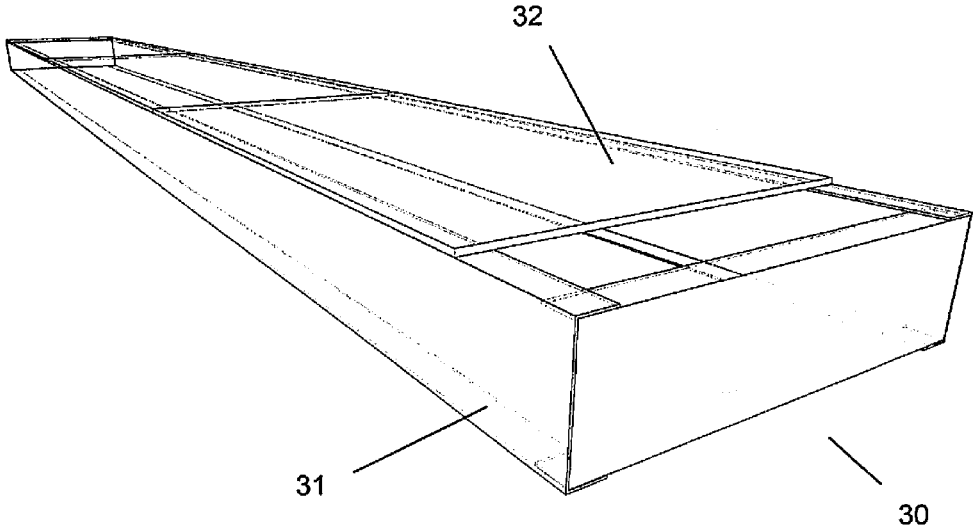
FIG. 5 illustrates an example floor panel 30 used for this hybrid building system including a bottom steel frame 31 made of U or C section stud and a top sheathing 32.
Figure 6:
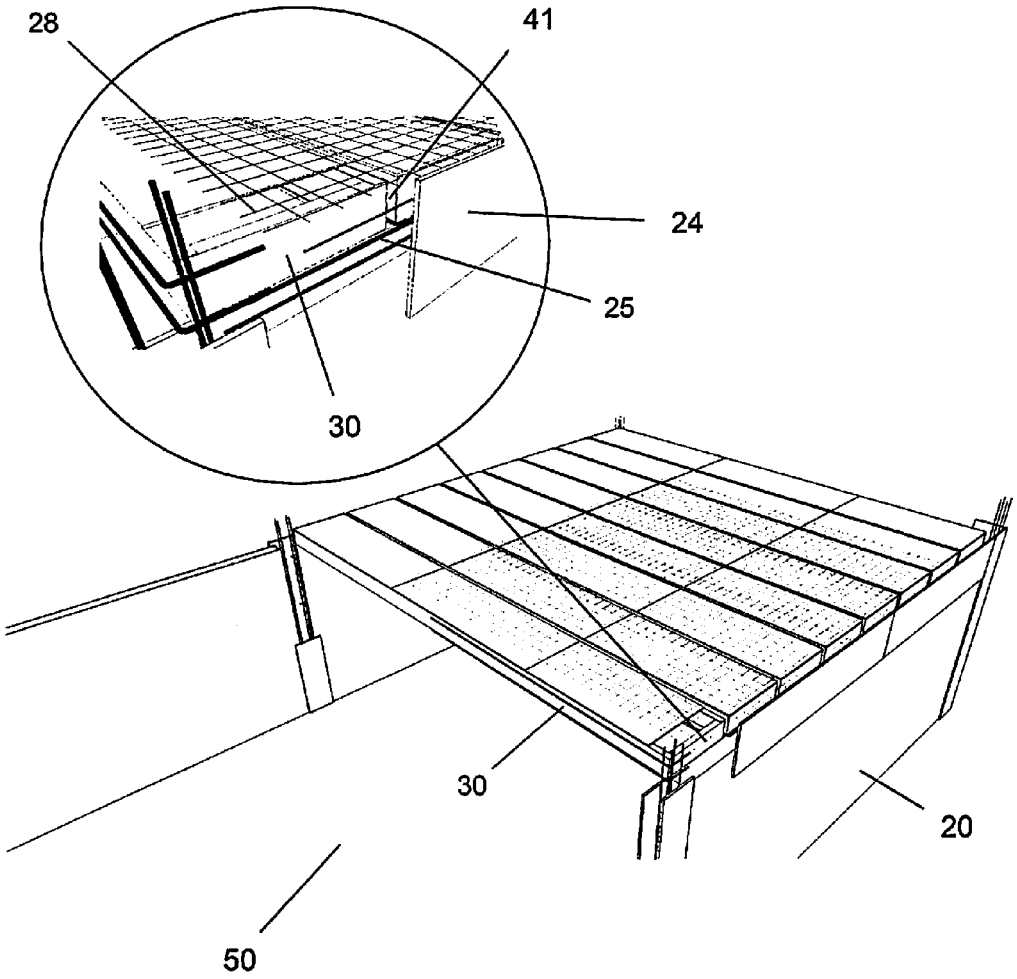
FIG. 6 illustrates an example assembly 50 of both wall panels 20 and floor panels 30 in place prior to casting of columns, beams, and floor system. Details of how a rebar column 25, a steel mesh 28, and formworks 24 for beams and columns are in place and how joist cavities 41 are formed when the floor panels 30 are placed adjacent to each other.

This hybrid precast system 20 can be adopted to use as a flooring system on the market provided that a thickness of floor planks or panels is sufficient to form the required height of the floor beams. The preferred flooring system of this hybrid component system is based on a floor panel design 30 shown in FIG. 5. As shown in FIG. 5, the floor panel design 30 comprises a bottom frame structure 31 made out of U or C section steel frame with a top sheathing cover 32 that can be of a thin concrete layer or a concrete formwork or a cementitious board. This type of flooring system works well with Applicant's component building system as the panel's height is high enough to form the horizontal beams for the system. When floor panel boxes 30 are set in place with spacing 41 between them, the whole assembly 50 illustrated in FIG. 6 becomes a cast-in-place form work for a concrete floor with floor joists formed in the spaces 41 between the floor panel boxes 30. The floor boxes 30 can be stay-in-place formworks or be removable formworks to save cost of materials. Leaving floor panel boxes 30 in place can certainly reduce construction time. This preferred flooring system is simple, fast to produce, and it requires low cost equipment to do the floor. With any common local flooring system, Applicant's component building system with its unique design and specifications can be adopted to create the same cast-in-place superstructure as the local traditional one. However, when implementing a concrete joist system as in the preferred flooring system shown in FIG. 6, concrete and steel materials can be reduced at least 15% and an effective weight reduction will further reduce the materials at the foundation level also.

The construction steps or method of this hybrid building system according to an embodiment of the present invention is different from both traditional cast-in-place and precast system. The precast wall panels 20 are first erected on a floor slab, then the rebar 25 and formworks 24 are formed for columns. Concrete is then poured into column cavities and is allowed to set and harden overnight to form columns. Alternatively, concrete for columns can be postponed and poured at the same time for the floor slab. The floor panels 30 are then placed and secured over the wall panels 20 with rebar 25 and steel mesh follows. Concrete is then poured over the floor panel and inside formwork with all steel connections and re-enforcements to allow hardening and lock all components in place. The construction process or steps mention previously will repeat for each floor construction. As one can deduce, the construction of each floor can be done in a few days, typically between 3 to 4 days, which is much faster in time and less labor relatively to the traditional construction method.

While there have been illustrated and described what are considered to be example embodiments of the present invention, it will be understood by those skilled in the art that various changes and modifications may be made, and equivalents may be substituted for elements thereof without departing from the true scope of the present invention. Therefore, it is intended that the present invention not be limited to the particular embodiment disclosed as the best mode contemplated for carrying out the present invention, but that the present invention includes all embodiments falling within the scope of the appended claims.

What is claimed is:

1. A hybrid building system designed to integrate both precast elements and cast-in-place elements therein, the hybrid building system comprising:

a superstructure frame including cast-in-place concrete columns designed to support a vertical load and a floor system for multi-level structure, each concrete column having a minimum cross-section area of 7100 square millimeter (11 square inch); and non-load bearing precast wall panels of a closed sandwich or an open frame design, each precast wall panel having protruding edges at both sides and embedded steel connecting devices designed to attach to the cast-in-place concrete columns and the floor system of the superstructure frame, and each precast wall panel having a weight under 35 lb/ft2 (170 kg/m2) with a maximum total weight of 5 metric ton.

2. The hybrid building system according to claim 1, wherein the non-load bearing precast wall panels of a closed sandwich panel design are provided with outside concrete layers no thicker than 2 inches or 50 mm, one or two protruding edges at left and right sides of each panel, and steel connecting devices designed to connect to left and right cast-in-place columns and a top horizontal beam of the floor system.

3. The hybrid building system according to claim 1, wherein the non-load bearing precast wall panels of a closed sandwich panel design are provided with a protruding edge at a top side of each wall panel extending to the same height as a cast-in-place floor beam attached to the wall panel.

4. The hybrid building system according to claim 1, wherein the non-load bearing precast wall panels of an open frame design are provided with a concrete layer no thicker than 2 inches, one or two protruding edges at left and right sides of each wall panel, and steel connecting devices designed to connect to left and right cast-in-place columns and a top horizontal beam of the floor system.

5. The hybrid building system according to claim 1, wherein the non-load bearing precast wall panels of an open frame design are made entirely of re-enforced concrete and a top side of each wall panel has another protruding edge extending to the same height as a cast-in-place floor beam attached to each wall panel.

6. The hybrid building system according to claim 1, wherein the non-load bearing precast walls of an open frame design are provided with a back frame system made of steel attached to a front concrete slab and a top side of each wall panel has another protruding edge extending to the same height as the cast-in-place floor beam attached to each wall panel.

7. A process of constructing a hybrid building system which integrates both precast elements and cast-in-place elements therein, the process comprising:

forming a superstructure frame including a floor system to support a multi-level structure;

forming non-load bearing precast wall panels of a closed sandwich or an open frame design on the floor system of the superstructure frame, each precast wall panel having protruding edges at both sides and embedded steel connecting devices designed to be secured within cast-in-place concrete columns and a floor system of the superstructure frame, and having a weight under 35 lb/ft2 (170 kg/m2) with a maximum total weight of 5 metric ton; and forming cast-in-place concrete columns between adjacent precast wall panels to support vertical loads and the floor system for multi-level structure, each concrete column having a minimum cross-section area of 7100 square millimeter (11 square inch).

8. The process according to claim 7, wherein the non-load bearing precast wall panels of a closed sandwich panel design are provided with outside concrete layers no thicker than 2 inches or 50 mm, one or two protruding edges at left and right sides of each wall panel, and embedded steel connecting devices designed to connect to left and right cast-in-place columns and a top horizontal beam of the floor system.

9. The process according to claim 7, wherein the non-load bearing precast wall panels of a closed sandwich panel design are provided with a protruding edge at a top side of each precast wall panel extending to the same height as a cast-in-place floor beam attached to the precast wall panel.

10. The process according to claim 7, wherein the non-load bearing precast wall panels of an open frame design are provided with a concrete layer no thicker than 2 inches, one or two protruding edges at left and right sides of each precast wall panel, and embedded steel connecting devices designed to connect to left and right cast-in-place columns and a top horizontal beam of the floor system.

11. The process according to claim 7, wherein the non-load bearing precast wall panels of an open frame design are made entirely of re-enforced concrete and a top side of each precast wall panel has another protruding edge extending to the same height as a cast-in-place floor beam attached to each precast wall panel.

12. The process according to claim 7, wherein the non-load bearing precast walls of an open frame design are provided with a back frame system made of steel frame attached to a front concrete slab and a top side of each precast wall panel has another protruding edge extending to the same height as the cast-in-place floor beam attached to each precast wall panel.

13. A process of constructing a hybrid building system which integrates both precast elements and cast-in-place elements therein, the process comprising:

forming a superstructure frame including a floor system for multi-level structure and formworks for cast-in-place concrete columns;

erecting non-load bearing precast wall panels of a closed sandwich or an open frame design on the floor system of the superstructure frame, each precast wall panel having a weight under 35 lb/ft2 (170 kg/m2) with a maximum total weight of 5 metric ton and including protruding edges at both sides and embedded steel connecting devices designed to be secured within cast-in-place concrete columns of the superstructure frame; and forming the cast-in-place concrete columns between adjacent precast wall panels to support vertical loads and a floor system for multi-level structure, each concrete column having a minimum cross-section area of 7100 square millimeter (11 square inch), wherein the cast-in-place concrete columns are formed by pouring concrete into column cavities created between adjacent precast wall panels and allowing the concrete to harden and secure the adjacent precast wall panels, via the protruding edges and embedded steel connecting devices of the adjacent precast wall panels, and wherein the non-load bearing precast wall panels of a closed sandwich panel design are provided with outside concrete layers no thicker than 2 inches or 50 mm, one or two protruding edges at left and right sides of each precast wall panel, and the embedded steel connecting devices designed to connect to left and right cast-in-place columns and a top horizontal beam of the floor system.

14. The process according to claim 13, wherein the non-load bearing precast wall panels of an open frame design are provided with a concrete layer no thicker than 2 inches, one or two protruding edges at left and right sides of each precast wall panel, and embedded steel connecting devices designed to connect into left and right cast-in-place columns and a top horizontal beam of the floor system.

15. The process according to claim 13, wherein the non-load bearing precast wall panels of an open frame design are made entirely of re-enforced concrete and a top side of each precast wall panel has another protruding edge extending to the same height as a cast-in-place floor beam attached to each precast wall panel.

16. The process according to claim 15, wherein the non-load bearing precast walls of an open frame design are provided with a back frame system made of steel frame attached to a front concrete slab and a top side of each precast wall panel has another protruding edge extending to the same height as the cast-in-place floor beam attached to each precast wall panel.

* * * * *